US005162028A

United States Patent [19]

Wilkinson

[11] Patent Number: 5,162,028

[45] Date of Patent: Nov. 10, 1992

[54] ADJUSTABLE HEIGHT AND LENGTH AEROBIC STEP/BENCH DEVICE

[76] Inventor: William T. Wilkinson, P.O. Box 378, Chesapeake City, Md. 21915

[21] Appl. No.: 754,075

[22] Filed: Sep. 3, 1991

[51] Int. Cl.[5] ..... A63B 5/00

[52] U.S. Cl. ..... 482/52; 297/438; 108/65

[58] Field of Search ..... 248/346, 670; 108/102, 108/65, 143; 297/438, 439; 182/223; 482/52, 23

[56] References Cited

U.S. PATENT DOCUMENTS

| | | | |
|---|---|---|---|
| 3,242,509 | 3/1966 | Nissen | 482/23 X |
| 3,636,576 | 1/1972 | Nissen | 482/23 X |
| 4,297,952 | 11/1981 | Zagaroli | 108/65 X |
| 4,686,910 | 8/1987 | Skjerseth | 108/65 X |
| 4,991,325 | 2/1991 | Teduschi . | |

FOREIGN PATENT DOCUMENTS

| | | | |
|---|---|---|---|
| 2546703 | 12/1984 | France | 108/65 |

*Primary Examiner*—Gene Mancene
*Assistant Examiner*—L. Thomas
*Attorney, Agent, or Firm*—Connolly & Hutz

[57] ABSTRACT

An adjustable height and length aerobic step/bench device includes a base having a horizontal platform with a depending skirt. The base includes connecting elements for detachably receiving legs so that the elevation or height of the platform can be varied. Additionally, the platform itself includes structural elements to selectively permit the length of the platform to be varied.

31 Claims, 4 Drawing Sheets

ADJUSTABLE HEIGHT AND LENGTH AEROBIC STEP/BENCH DEVICE

BACKGROUND OF INVENTION

Step aerobics using an adjustable height aerobic step has become a fitness craze. To date, I have disclosed in my various patents and applications techniques for adjusting the height of the step in order to obtain proper safety, universal use by all sizes of people, knee comfort and safety, and the ability to vary the climbing/workout effort.

There are two basic sizes of adjustable height steps presently in use. One is what may be considered a larger step for commercial use, such as in health clubs. The larger step is longer allowing more side to side movements. The second is a smaller step for home use that is lighter, more portable and more compact for storage purposes. However, since the second step is smaller, the side to side movements are very limited. Additionally, where there is a smaller surface on which to lie the performing of warm-up exercises is severely limited.

There is therefore a need for an aerobic exercise step/bench that is adjustable in its length as well as having height adjustability.

SUMMARY OF THE INVENTION

An object of this invention is to provide an exercise step/bench device capable of fulfilling the above need.

A further object of this invention is to provide such a device which has basic height, length and width dimensions and which may be varied in its height and length dimensions. In one practice of the invention the width dimension may also be varied.

In accordance with this invention the adjustable height and expandable length aerobic step/bench device includes a base having a horizontal platform and a depending skirt which may be around the entire periphery of the platform or may be at spaced locations. The base includes structure for detachably receiving legs which may be used to vary the height of the platform. Additionally, the platform itself has structural elements that permits the length of the platform to be adjusted.

In one practice of the invention length adjustability is achieved by adding an insert either to one or more ends of the base or by forming the base in two separate members which may be moved apart for receiving the insert in the center portion thereof.

In a further practice of this invention the base is formed of two parts telescopically arranged so that the length adjustment is achieved by a expansion or retraction of the telescopically arranged elements.

In a further practice of this invention width adjustability is achieved by, for example, adding clip on members in the width direction.

Height adjustability may be achieved in any known manner including the various techniques described in my prior patents and applications and the techniques in commercial use.

THE DRAWINGS

DETAILED DESCRIPTION

Figure 1:
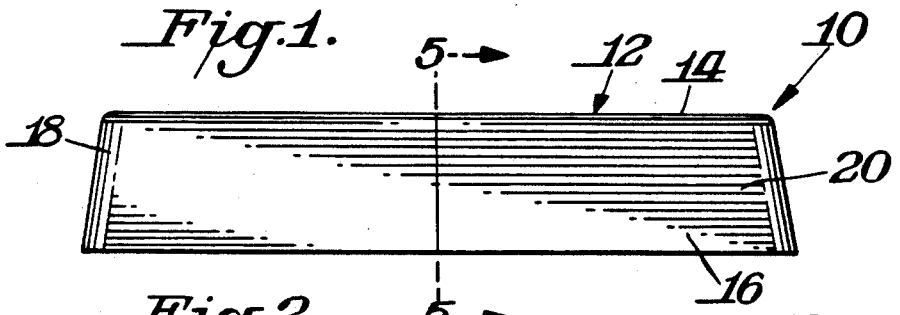
FIG. 1 is a side elevational view of an adjustable height and expandable length aerobic step/bench device in accordance with my invention.

Various approaches have been taken in the art to provide versatility to an aerobic step/bench by providing height adjustability. For example, in my various patents and applications I have disclosed various techniques for achieving such height adjustability usually in two inch increments so as to conform to the particular form of program needs of a user. Heretofore, however, such emphasis has been directed to adjusting the height or elevation of the step/bench device. The present invention makes use not only of the versatility afforded by height adjustability but expands upon this versatility by providing various techniques in which the length and if desired additionally the width of the step/bench may be adjusted.

FIGS. 1–6 show one manner of practicing this invention. As shown therein, the exercise device 10 is in the form of a base 12 having a generally horizontal upper platform 14 and a downwardly extending apron 16. In the various embodiments illustrated herein, apron 16 is shown as extending completely around the periphery of base 14. It is to be understood, however, that the invention may be practiced where the apron is formed at spaced locations as long as it achieves the function of providing an initial elevation of the platform 14. Thus, for example, where the height of apron 16 is four inches, the initial elevation of platform 14 would be four inches when the base is placed directly on a support surface, such as the floor.

As later described, base 12 includes receiving structure to which legs may be detachably connected so as to provide additional height adjustability of device 10.

Figure 2:
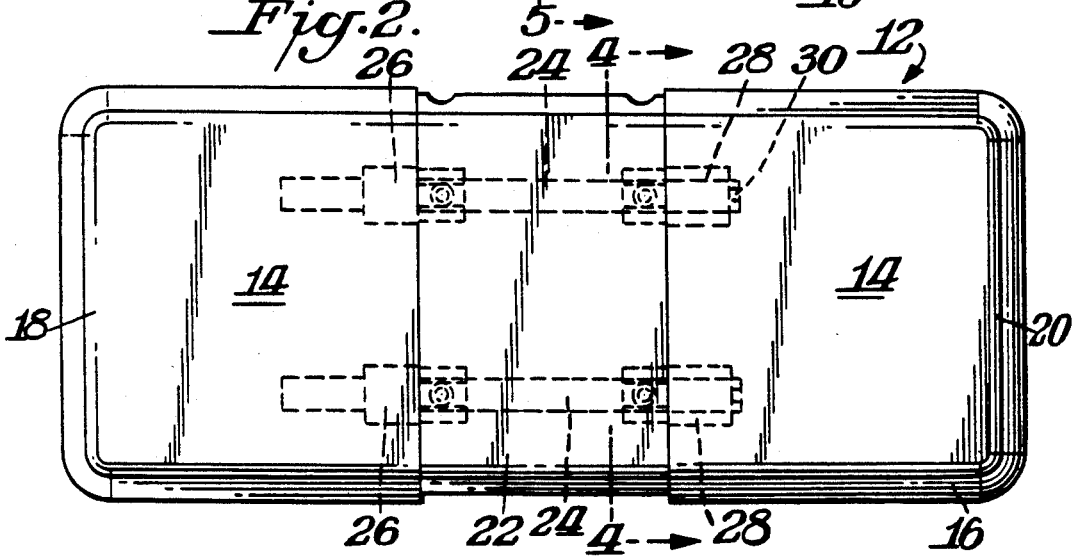
FIG. 2 is a top plan view of the device shown in FIG. 1 in its length expanded condition.
Figure 3:
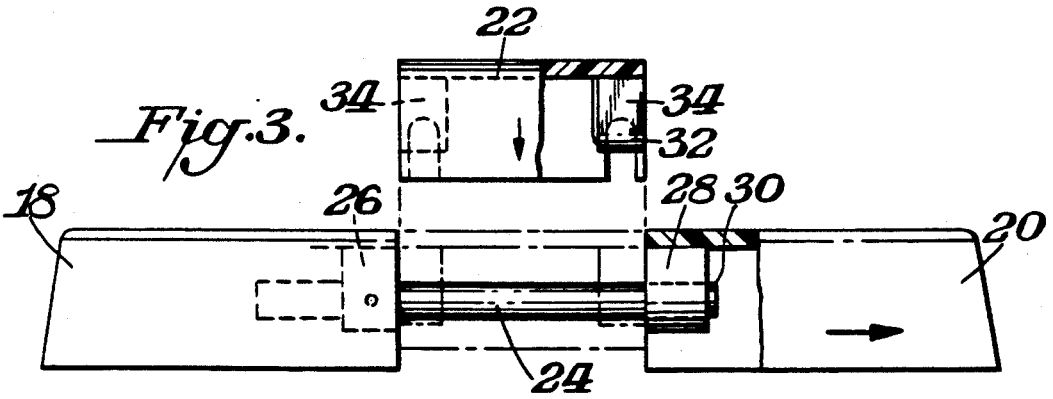
FIG. 3 is a side view partially in section showing insertion of the center insert for achieving length adjustability.

In the embodiment illustrated in FIGS. 1–6 base 12 is formed of two piece construction comprising right and left hand sections 18,20. When sections 18,20 abut against each other, as shown in FIG. 1, platform 14 has its smallest length dimension. When it is desired, however, to extend the length of platform 14 sections 18,20 are spread apart as shown in FIGS. 2–3 so that a center section 22 may be inserted between the spaced sections 18.20. For example, sections 18,20 may be connected to each other by a pair of rails 24,24 mounted in downwardly extending brackets 26,26 and 28,28. Rails 24,24 may take any suitable form, such as being tubular members which are fixedly secured to brackets 26,26 and which are slidably secured in brackets 28,28. Thus, when it is desired to expand the length of platform 14 section 20 would be pulled away from section 18 as shown by the arrow in FIG. 3 until upstanding pins or stop members 30 at the end of rails 24, 24 are contacted by brackets 28,28. This creates a gap between the adjacent edges of sections 18,20. The extension piece 22 is dimensioned to snugly fill the gap and is inserted downwardly as shown by the arrow in FIG. 3 to fit on rails 24,24. When in its seated condition a smooth uninterrupted surface results from the three piece unit comprising end sections 18,20 and center length extension section 22. Center extension section 22 may be mounted and placed in any suitable manner. In the illustrated embodiment swivel spring clips 32 are secured to downward extensions 34 of extension piece 22. Spring clips snap over tubular rails 24 to be held in place and an upward pull would dislodge the clips for removal of the extender 22.

Figure 4:
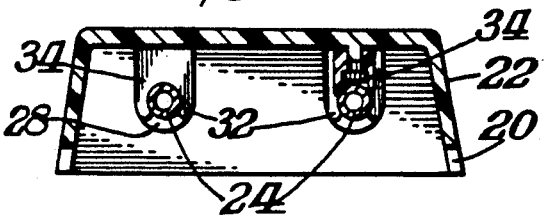
FIG. 4 is a cross-sectional view taken through FIG. 2 along the line 4—4.
Figure 5:
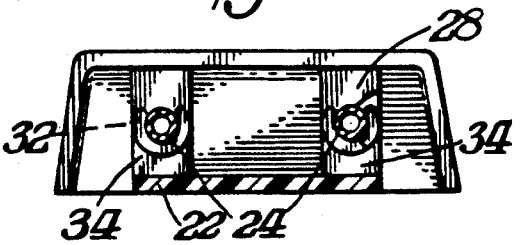
FIG. 5 is a cross-sectional view taken through FIG. 1 along the line 5—5.
Figure 6:
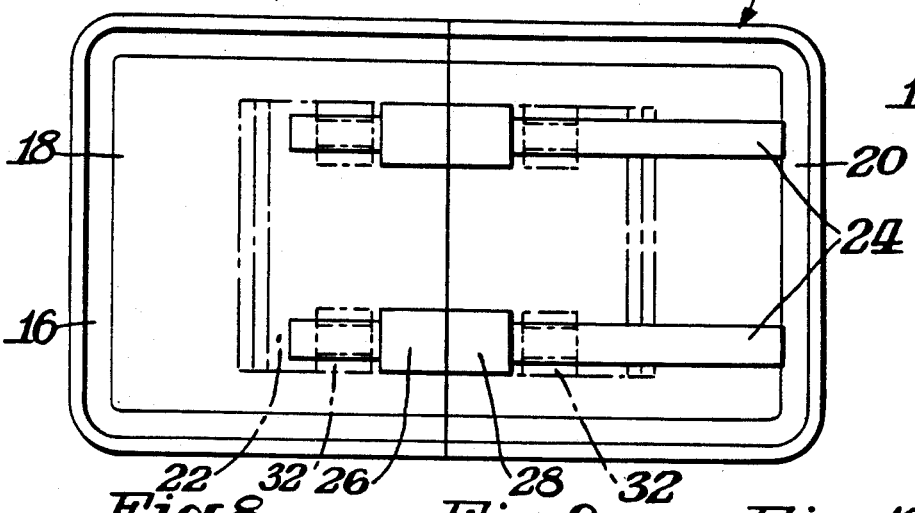
FIG. 6 is a bottom plan view of the device shown in FIG. 1.

A further feature of the invention is the utilization of the same swivel clips 32 for storing extender 22 within apron 16 below platform 14 when base 12 is in its smallest length condition. FIG. 6, for example, is a bottom plan view illustrating center piece 22 to be stored within the periphery of apron 16. In this stored condition, clips 32 would be swiveled so that the open ends of the clips face upward as shown in FIG. 5 to snap onto rails 24,24 at the bottom side. In contrast, FIG. 4 illustrates the swivel clips 32 to face downward for snapping on rails 24,24 when extension piece 22 is mounted in its operative rather than stored condition.

A further advantage of storing extender 22 within the periphery of apron 16 is that the extender acts as a lock to assure that sections 18,20 will not inadvertently separate from each other. As shown in FIG. 6, the various spring clips 32 are secured to rails 24,24 on opposite sides of the dividing line between the two sections 18,20. If desired, any other suitable means such as clips and hooks may be provided to lock sections 18,20 juxtaposed each other when no extender is in place other than using the extender 22 itself as the locking means.

The advantage of device 10 is that with one extension piece 22 it is possible to convert the step/bench device from a smaller home model dimensioned as shown in FIG. 1 to a larger model suitable for exercise club use as shown in FIG. 2.

In a preferred practice of the invention the base in its condition shown in FIG. 1 would be about 30 inches long, 16 inches wide and four or six inches high. The extension piece 22 would be thirteen inches long, sixteen inches wide and would thereby extend the overall length of platform 14 to forty-three inches which is an ideal club size dimension.

Although the invention may be practiced by providing length adjustability without any height adjustment, the invention preferably contemplates the use of various means to achieve height adjustability. Usually, such height adjustability means would include detachable legs mounted at the ends of the device. The use of a center extension piece, such as extension piece 22 is particularly advantageous because it does not interfere with the adjustable legs located at the ends of the device.

It is to be understood that although FIGS. 1–6 illustrate the invention as being practiced with a single extension piece, the invention may also be practiced with a plurality of extension pieces used singly or in multiples with a set of extension pieces of different lengths wherein one length would be used to achieve one extension and a second length of the set would be used for achieving a different extension and so on.

As previously indicated, another feature of the invention is that the device is capable of achieving height adjustability in addition to the basic height afforded when the base 12 itself is mounted directly on the support surface such as having apron 16 mounted on a floor. FIGS. 7–14 illustrate various techniques that may be used for achieving such height adjustability. It is to be understood that such techniques are for illustrative purposes only and are not meant to limit the practice of the invention.

Figure 7:
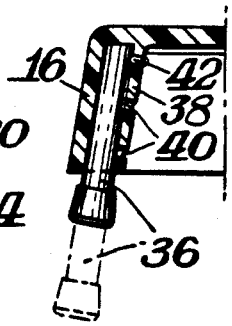
FIGS. 7–14 are cross-sectional views in elevation showing various techniques for achieving height adjustability for the device of FIGS. 1–6.

FIG. 7 illustrates one form of height adjustability wherein a leg 36 would be inserted into a pocket 38 at each corner of base 12. Pocket 38 would have a series of holes 40 which selectively receive a spring biased pin 42 on leg 36 to lock leg 36 in place. FIG. 7, for example, illustrates one height adjustability wherein pin 42 is disposed in the upper most hole 40 as shown in solid lines. FIG. 7 illustrates in phantom the downward extension of leg 36 when pin 42 would be disposed in a lower hole, such as the lowermost hole. This concept of achieving height adjustability is described in application Ser. No. 07/533,004, filed Jun. 4, 1990, now abandoned, the details of which are incorporated herein by reference thereto.

Figure 8:
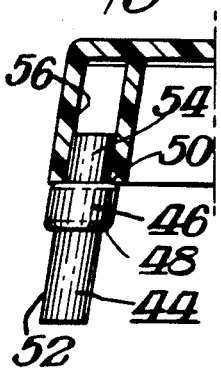

FIG. 8 illustrates a further method of achieving height adjustability. As shown therein a leg 44 includes an enlarged off center extension 46 having shoulders 48,50 so that a narrow portion 52 or 54 is on each side of a respective shoulder. The step device includes a pocket 56 for receiving the leg 44. When leg 44 is inserted in the position shown in FIG. 8 shoulder 50 limits the amount of extension thus achieving one height adjustability. When the leg is reversed and extension 52 is inserted in pocket 56 shoulder 48 limits the amount of extension and a smaller height adjustment is achieved. The concepts of this method of adjustment is described in application Ser. No. 07/588,449, filed Sep. 26, 1990, now abandoned, the details of which are incorporated herein by reference thereto.

Figure 9:
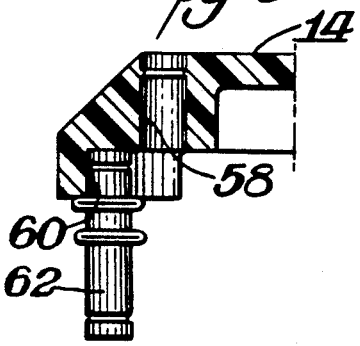

FIG. 9 illustrates yet another form of height adjustability wherein the base includes a pair of pockets or channels 58,60 displaced from each other located a different distance from the upper surface of platform 14. A leg 62 would be inserted in one of the pockets 58, 60 to achieve height adjustability. Copending application Ser. No. 07/615,249, filed Nov. 14, 1990, the details of which are incorporated herein by reference thereto describes this manner of adjustability. The concept of having differently located receiving means for effecting different height adjustability is also disclosed in above noted application Ser. No. 07/533,004.

Figure 10:
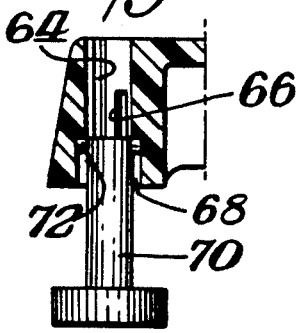

FIG. 10 illustrates yet another manner of achieving height adjustability wherein the base includes a pocket 64 having sets of slots 66,68 extending different lengths. The leg 70 has corresponding pins 72 for fitting in the slots. When pins 72 are inserted in slots 68 one height adjustability is achieved. When pins 72 are inserted in longer slots 66, a smaller height adjustability is achieved. These techniques are described in copending application Ser. No. 07/695,394, filed May 3, 1991, the details of which are incorporated herein by reference thereto.

Figure 11:
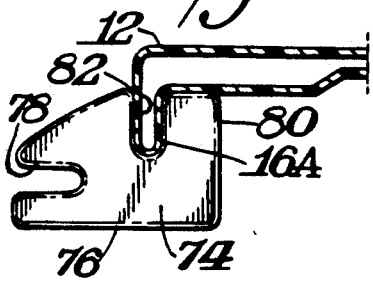

FIG. 11 shows yet another form of achieving height adjustability wherein the leg 74 is a block which includes a long side 76 having a parallel slot 78 and a shorter side 80 having a parallel slot 82. Leg 74 is mounted to base 12 by selectively fitting the apron 16A into a respective slot 78 or 82. This technique is commercially used and is described in the aforenoted application Ser. No. 07/588,449.

Figure 12:
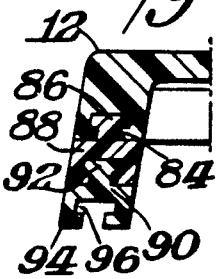
Figure 13:
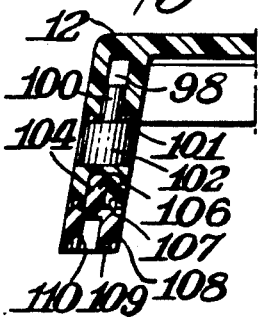

FIG. 12 illustrates yet another manner of height adjustability wherein the base 12 has an opening 84 shaped to receive extension 86 of leg 88. Leg 88 in turn has a similar opening 90 shaped for receiving extension 92 of further leg 94. Leg 94 in turn has a opening 96 of similar shape to openings 84 and 90 for receiving yet another leg and so forth. This technique and other techniques for height adjustability are described in copending application Ser. No. 07/698,382, filed May 10, 1991, the details of which are incorporated herein by reference thereto.

The above noted application Ser. No. 07/698,382 also illustrates the techniques shown in FIG. 13 wherein base 12 has a opening 98 for receiving the extension 100 of leg 102 with leg 102 having a similar opening 104 for receiving extension 106 of leg 108. Leg 108 in turn has an opening 110 for receding a further leg and so on. Pins 101 on leg 102 fit in holes in the apron, similar to holes 109 of leg 108. Similarly, pins 107 on leg 108 fit into holes in leg 102. As described in application Ser. No. 07/698,382 the various legs may be detached by insertion from the center of the device or from the ends of the device.

Figure 14:
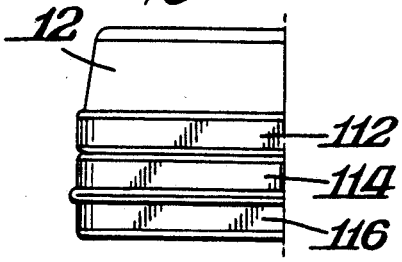

FIG. 14 illustrates yet another manner of achieving height adjustability wherein a series of legs or spacers 112,114,116 etc. may be secured together by interlocking or in any other fashion and then selectively secured to base 12. The general concept of providing spacers for achieving height adjustability is disclosed in U.S. Pat. No. 4,984,785. An aspect of that concept using interlocking squares is also practiced commercially and it is to be understood that such manners of achieving height adjustability may be incorporated in the practice of this invention.

In addition to or in place of the various above described manners of achieving height adjustability the invention may also be practiced using the techniques described in copending application Ser. No. 07/577,282, filed Sep. 4, 1990, the details of which are incorporated herein by reference thereto. In that application a mat is used onto which the base may be placed for elevating the platform. The mat may be formed in plural panels to vary the elevation of the platform. The mat may be used to replace or supplement the legs for height adjustability.

It is also to be understood that the invention may be practiced without any height adjustability and by simply using the height provided by the base 12 itself when the apron 16 is mounted directly on the floor. In that practice of the invention it is the expandability of the base that provides the versatility of the invention in permitting the base to be selectively converted to a small home use type device and a larger club type device.

It is also to be understood that the various manners of height adjustability described above are not intended to be limiting. For example, although some of the various applications disclose a leg in each corner of the base, the invention may also be practiced by having a single leg at each end of the base wherein the leg is of widened construction or includes a widened foot at its lower end. Similarly, instead of legs, height adjustability could be achieved by mounting base 12 on a pedestal which could also be height adjustable. Where the base is mounted on a mat, pedestal or other elevating means, the portion of the base making such contact with the elevating means is considered as receiving means for receiving the elevating means.

Figure 15:
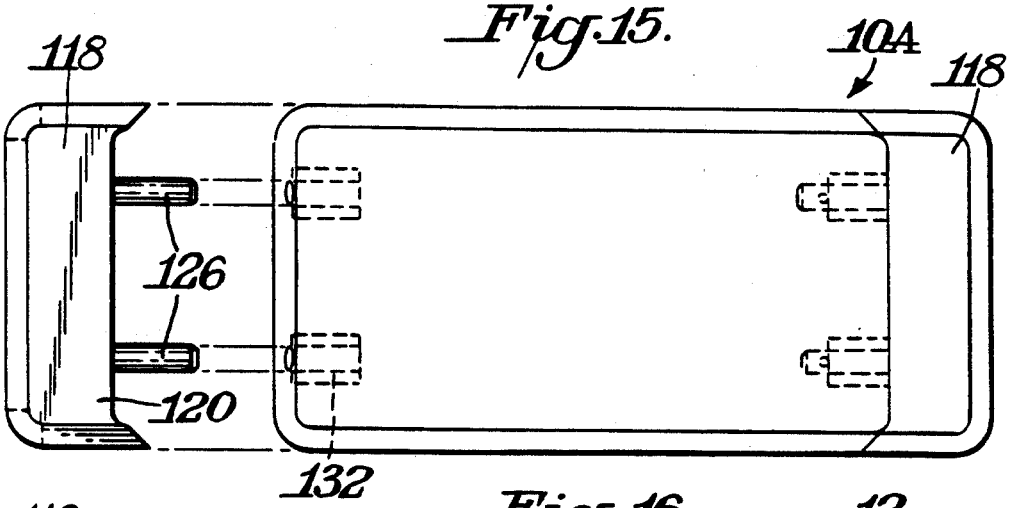
FIG. 15 is a top plan view showing a further embodiment of this invention for achieving length adjustability.
Figure 16:
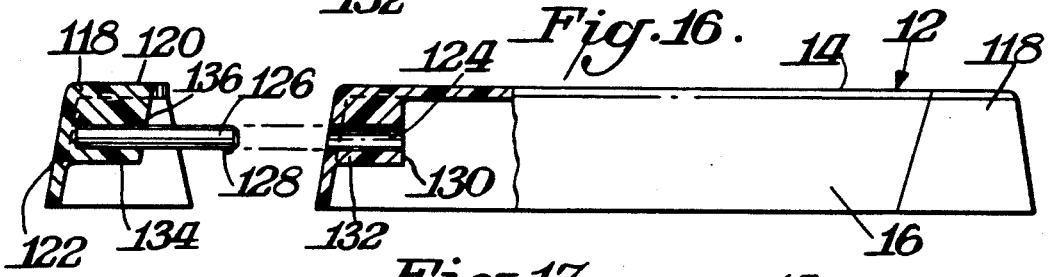
FIG. 16 is a side elevational view partly in section of the device in FIG. 15.

FIGS. 15–16 illustrate a variation of the invention for achieving expandability. As shown therein, the device 10A includes a base 12 having a upper platform 14 with a depending skirt 16, similar to the device 10 of FIGS. 1–6. Base 12, however, is made of unitary construction rather than being two separate base sections. Length adjustability is achieved by adding an extender 118 at one or both ends of base 12. The manner of adding extender 118 may vary. In the illustrated embodiment each extender 118 includes an upper surface 120 which would be a planar extension of surface 14 when extender 118 is mounted in place. Similarly, a downwardly extending skirt 122 would be provided which would also form a smooth extension of skirt 16. Accordingly, when the extender is mounted in place the effective length of platform 14 is increased without any breaks in the surface of platform 14.

FIGS. 15–16 illustrate skirt 16 to include channels or openings 124 into which rods 126 of each extender 118 would be inserted. If desired, locking element such as a spring pin 128 could be included at the end of each rod 126 for extending downwardly beyond pocket or channel 124 and in abutment with the outer wall 130 of its mounting member 132 provided on skirt 16. Mounting block 134 on extender 118 includes an outer surface 136 which is of the same inclination of the outer surface of skirt 16 to fit juxtaposed to skirt 16. In this practice of the invention, where height adjustability is achieved by having one or more legs at each end of base 12, the leg receiving structure could also be provided in extensions 118. Alternatively, the leg receiving structure could still be maintained only in base 12 itself wherein the legs would be disposed inwardly of the extended base formed by the addition of extenders 118.

It is also to be understood that the concept of the invention involving the use of end extenders may be practiced with the end extenders taking other forms. For example, each end extender could include a downwardly extending skirt a illustrated in FIGS. 15–16 or the end extenders may simply have a horizontal surface which would be co-planar with platform 14 and a depending horizontal tongue which would fit in corresponding slots in skirt 16 to cantilever the extenders.

Figure 17:
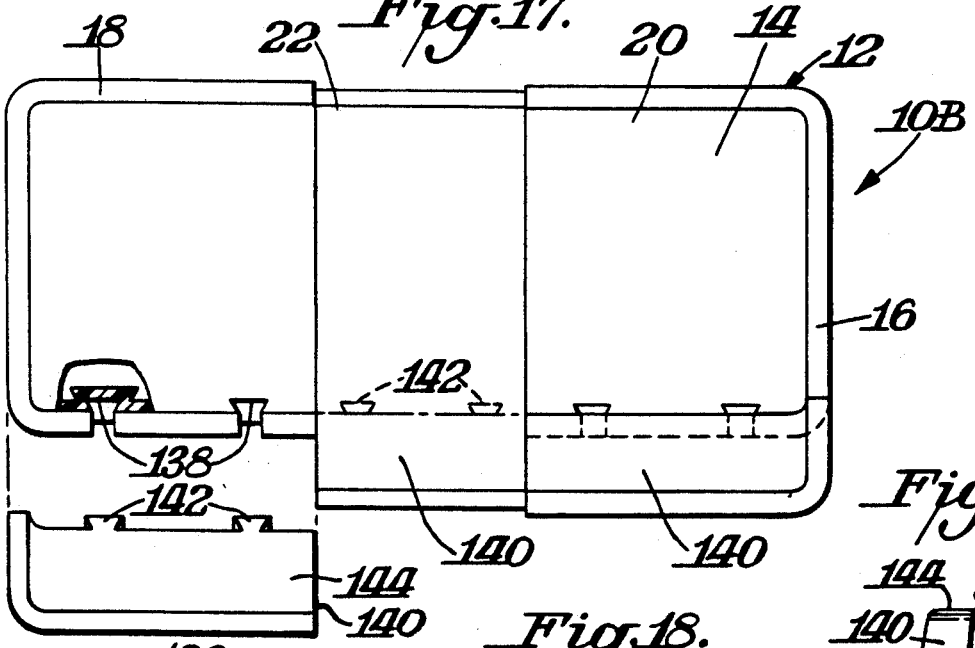
FIG. 17 is a top plan view partly in section of yet another form of this invention for achieving width adjustability.
Figure 18:
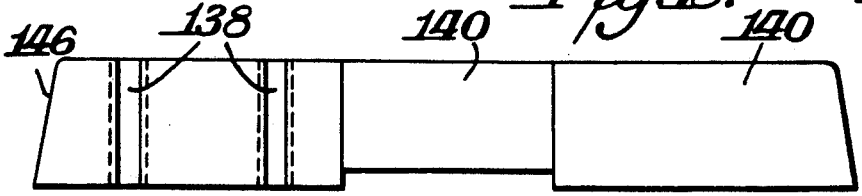
FIG. 18 is a side elevational view of the device shown in FIG. 17.
Figure 19:
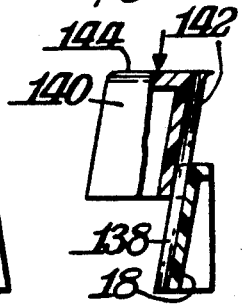
FIG. 19 is a side elevational view partly in section showing the manner of achieving width adjustability for the device of FIGS. 17–18.

It is also to be understood that the invention may be practiced by extending the width of the device in addition to extending its length. Such concepts may be practiced in any suitable form. FIG. 17, for example, illustrates a variation of the invention wherein the device 10B functions in a manner similar to device 10 in that the base 12 is comprised of two end sections 18,20 with a center insert 22. Each of the three sections 18, 20 and 22 would include some structure for attaching additional width extenders along one or both opposite parallel edges. FIGS. 17–19, for example, illustrate each section 18,20 and 22 to include dovetailed openings 138 spaced along their edges. Although not illustrated openings 138 may be provided along the opposite parallel edge for further width expansion. A width extender 140 is provided for each section 18, 20, 22. Each width extender 140 would include a tongue 142 shaped to fit in a corresponding dovetailed opening 138. Each width extender would also include a top surface 144 and a depending skirt 146 of a shape to complement the corresponding platform 14 and skirt 16 of base 10 so as to result in an unbroken outer surface. FIG. 19 illustrates the manner of inserting each width extender 144 into the dovetailed slot 138 of its corresponding section.

It is to be understood that the structure shown for extenders 140 are merely for exemplary purposes. Thus, the width extenders may take other shapes, such as simply being a plate like shape which would be co-planar with platform 14 and which could have some connector including a horizontal tongue fitting into a horizontal slot of its corresponding base section. Additionally, where width extenders 140 are used the width extenders. Additionally, where width extenders 140 are used the width extenders may use leg receiving structure so that when legs are incorporated for height adjustability the legs could be mounted to the width extenders instead of to end sections 18,20. It is also to be understood that although FIGS. 17–19 illustrate width extenders, particularly adaptable for the type of length extenders illustrated in FIGS. 1–6 the concept of employing width extenders may be used with other length extenders. Thus, in the embodiment of FIGS. 15–16 the width extenders could be provided wherein there would be a width extender for the center spaced member as well as a width extender for easy length extender 118.

Figure 20:
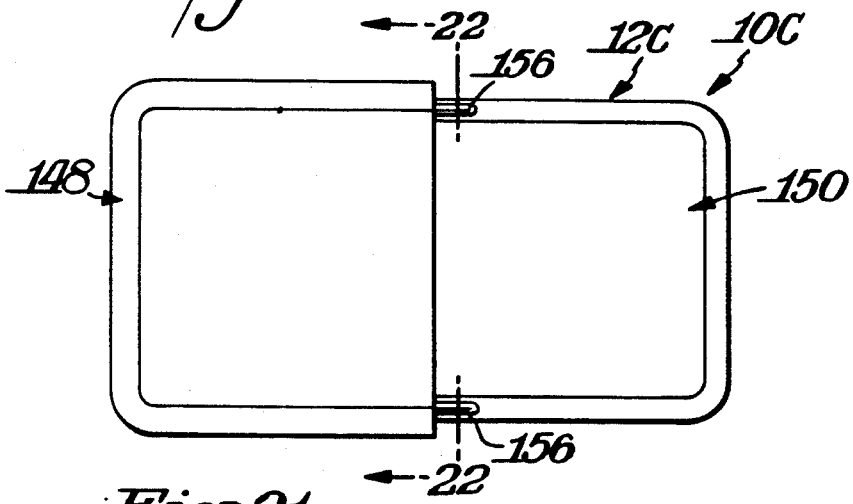
FIG. 20 is a top plan view showing yet another embodiment of this invention for achieving length adjustability.
Figure 21:
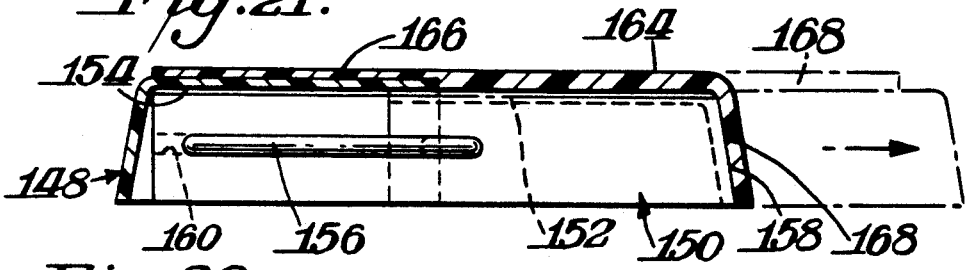
FIG. 21 is a cross-sectional view in elevation of the device shown in FIG. 20.
Figure 22:
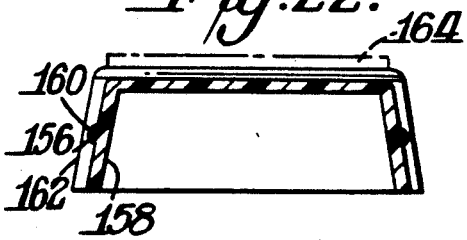
FIG. 22 is a cross-sectional view taken through FIG. 20 along the line 22—22.

FIGS. 20–22 illustrate yet another variation of the invention for providing length extension. As shown therein device 10C includes *3a* base made of two sections 148, 150. Section 150 has an upper wall 152 which telescopes under the lower surface of upper wall 154 of section 148. Section 150 also includes longitudinal ribs 156 on its apron 158 for fitting in grooves 160 of the apron 162 in section 148. Accordingly, the relative length of base 12C can be extended by the degree of telescoping position of section 150 into section 148. The advantage of device 1OC is that the degree of length adjustability is completely variable rather than incremental as in the other embodiments. If desired suitable locking means may be utilized to lock sections 148, 150 together after the length adjustment.

In order to provide a flat continuous upper surface for device the embodiment of FIGS. 20–22 illustrate a mat 164 to be on the upper surface. Mat 164 would include a thin extension 166 of a length corresponding to the length of section 148. Preferably, thin section 166 would be fixed to the upper surface 154 of section 148. In this respect, thin extension 166 could be permanently mounted by adhesive or other suitable anchoring means or could be detachably mounted by any suitable fastener. The portion of mat 164 extending over extension 150 would not be secured to section 150. Additionally, this section of mat 154 over section 150 would be thicker than extension 166 so that its overall thickness would be the combined thickness of extension 166 and upper wall 154. FIG. 21 illustrates in solid how the end 168 of mat 164 drapes downwardly over the outer end of section 150. As extension 150 is extended, a lesser amount of thickened end 168 would be disposed downwardly. FIG. 21 illustrates in phantom the full extension of section 150 with mat 164 being completely horizontal.

It is to be understood that although FIGS. 20–22 illustrate the use of a mat on the top surface of base 12C to provide a generally planar upper surface or platform, the invention may be practiced without such a mat. For example, a separate mat or transition piece could be provided only on section 150 of a thickness to fit flush against the upper surface 154 of section 148. If desired, the invention may be practiced with no mat at all although there would then be a slight difference in elevation of the upper surface of base 12C. The provision of a mat, however, is preferred since it removes any safety dangers or unsightliness that would result from the difference in elevation. In addition, the mat 154 could be made of a non-slip material to further add to its safety.

As can be appreciated the present invention thus provides an adjustable height/length step that selectively functions as two steps in one for club or home type use which combines the best features of both types of devices. As a club device the device can be reduced in size for storage and carrying. Additionally, a variety of sizes could be available. As a home device the device can be expanded for greater lateral movement and to provide an increased surface for warm-up exercises.

What is claimed is:

1. An expandable aerobic step/bench device comprising a base having a horizontal platform and a depending apron, said platform having a length dimension and a width dimension, said apron being adapted to support said platform when said apron is placed directly on a support surface to provide a first height position of said platform whereby a user may repeatedly step on to and off from said platform during an aerobic exercise, and said base having length connecting means along said width dimension for connection to at least one length extender which ma be selectively mounted to and detached from said base for varying the length of said base.

2. The device of claim 1 including said length extender, said length extender having complementary length connecting means for engagement with said length connecting means of said base, and said length extender having an upper surface generally co-planar with and juxtaposed to said platform to form a continuous extended length platform.

3. The device of claim 2 including receiving means on said base for selectively mounting elevating means to said base to vary the height of said platform.

4. The device of claim 3 wherein said base includes a pair of opposite ends, said receiving means being at each of said ends, at least one leg at each of said end, and each of said legs having mounting means for selective coupling to a corresponding one of said receiving means.

5. The device of claim 4 wherein each of said legs is capable of being coupled to said receiving means in a manner which selectively provides at least two height adjustments in addition to said first height position.

6. The device of claim 5 wherein said receiving means includes a pocket having a series of holes, and each of said legs having a spring pin for selective engagement with said holes.

7. The device of claim 5 wherein said leg receiving means includes a pocket, each of said legs having an enlarged off center section with a stop shoulder on each side of said enlarged section and a different length extension on each side of said enlarged section, one of said different length extensions being inserted into said pocket, and stop shoulder limiting the degree of insertion into said pocket.

8. The device of claim 5 wherein said receiving means comprises a pair of channels, and each of said legs being inserted into one of said channels.

9. The device of claim 5 wherein said receiving means is a pocket, said pocket having at least two sets of different length slots, and each of said legs having pin means for fitting into one of said slots.

10. The device of claim 5 wherein said leg is in the form of a block including a pair of connected sides of differing length, a pair of slots in opposite portions of said block perpendicular to each other, and said apron fitting in one of said slots.

11. The device of claim 5 wherein said receiving means comprises a first groove in said base, a first tongue on said leg fitting in said groove, a second groove in said leg, a second leg, and a second tongue on said second leg fitting in said second groove.

12. The device of claim 5 wherein said receiving means comprises an opening in said apron, each of said legs having an extension at one end and an opening at its other end, said extension being inserted into said apron opening, a second leg having a further extension fitting into said opening of said leg.

13. The device of claim 5 wherein each of said legs comprises a stack of spacers mounted under said base.

14. The device of claim 5 including width connecting means along said length dimension for connection to at least one width extender which may be selectively mounted to and detached form said base for varying the width of said base.

15. The device of claim 3 wherein said base comprises a pair of sections movable toward and away from each other.

16. The device of claim 15 wherein said length extender is an insert mountable between said sections when said sections are moved apart.

17. The device of claim 16 wherein said insert is storable under said platform during periods of non-use of said insert.

18. The device of claim 16 wherein each of said sections includes bracket means extending downwardly from said platform, rail means fixed to said bracket means of one of said sections and slidably mounted to said bracket means of the other of said sections, and said insert having clip means for connection to said rail means.

19. The device of claim 18 wherein said clip means are mounted in a swivel mannel for securement to said rail means when said insert is stored under said platform during periods of nonuse.

20. The device of claim 15 wherein each of said sections includes a top surface, one of said top surfaces being telescoped under the other of said top surfaces, and said one top surface being said length extender.

21. The device of claim 20 including a mat over said top surfaces to provide a continuous platform.

22. The device of claim 21 including grooves in one of said sections, and ribs in the other of said sections slidable in said grooves to comprise said connecting means.

23. The device of claim 22 wherein said mat is anchored to one of said top surfaces and draped over the other of said top surfaces.

24. The device of claim 3 wherein said length extender is an end piece for engagement with an end of said base.

25. The device of claim 24 including one of said length extenders at each end of said base.

26. The device of claim 3 including width connecting means along said length dimension for connection to at least one width extender which may be selectively mounted to and detached from said base for varying the width of said base.

27. The device of claim 1 including leg receiving means on said base for selectively mounting elevation means to said base to vary the height of said platform.

28. The device of claim 1 including width connecting means along said length dimension for connection to at least one width extender which may be selectively mounted to and detached from said base for varying the width of said base.

29. In a method of performing an aerobic exercise wherein the user obtains a step/bench device comprising a horizontal platform and an apron repeatedly steps up and down from a horizontal platform, the improvement being in manipulating the device to expand its length.

30. The method of claim 29 including performing a warm-up exercise on the device while in its expanded length, and contracting the device for the aerobic exercise.

31. The method of claim 29 including adjusting the height of the horizontal platform.

* * * * *